US006552692B1

(12) United States Patent
Zeilinger et al.

(10) Patent No.: US 6,552,692 B1
(45) Date of Patent: Apr. 22, 2003

(54) DUAL BAND SLEEVE DIPOLE ANTENNA

(75) Inventors: Steven Zeilinger, Carol Stream, IL (US); Felipe Zuniga, Addison, IL (US)

(73) Assignee: Andrew Corporation, Addison, IL (US)

( * ) Notice: Subject to any disclaimer, the term of this patent is extended or adjusted under 35 U.S.C. 154(b) by 0 days.

(21) Appl. No.: 10/016,237

(22) Filed: Oct. 30, 2001

(51) Int. Cl.[7] ..... H01Q 9/04; H01Q 9/16
(52) U.S. Cl. ..... 343/792; 343/791
(58) Field of Search ..... 343/790, 791, 343/793, 702, 900, 715, 901

(56) References Cited

U.S. PATENT DOCUMENTS

| | | | | |
|---|---|---|---|---|
| 2,821,709 A | | 1/1958 | Fucci | 343/790 |
| 3,139,620 A | | 6/1964 | Leidy et al. | 343/792 |
| 3,750,181 A | | 7/1973 | Kuecken | 343/790 |
| 4,410,893 A | | 10/1983 | Griffee | 343/792 |
| 4,509,056 A | | 4/1985 | Ploussios | 343/791 |
| 4,940,989 A | | 7/1990 | Austin | 343/791 |
| 4,963,879 A | | 10/1990 | Lin | 343/792 |
| 5,079,562 A | | 1/1992 | Yarsunas et al. | 343/792 |
| 5,248,988 A | * | 9/1993 | Makino | 343/792 |
| 5,440,317 A | | 8/1995 | Jalloul et al. | 343/791 |
| 5,719,587 A | | 2/1998 | Rodal | 343/791 |
| 5,812,097 A | | 9/1998 | Maldonado | 343/790 |
| 5,963,180 A | | 10/1999 | Leisten | 343/895 |
| 5,999,140 A | | 12/1999 | Johnson | 343/795 |
| 6,037,907 A | | 3/2000 | Ha et al. | 343/790 |
| 6,054,962 A | | 4/2000 | Ha et al. | 343/722 |
| 6,057,804 A | | 5/2000 | Kaegebein | 343/792 |
| 6,421,024 B1 | * | 7/2002 | Stolle | 343/792 |

* cited by examiner

*Primary Examiner*—Hoang Nguyen
(74) *Attorney, Agent, or Firm*—Vedder Price Kaufman & Kammholz

(57) ABSTRACT

An antenna comprising a center-fed coaxial dipole having a first element, configured as a whip and a second element having a first and second portion for transmitting/receiving in dual frequency bands. The first element, first portion and second portion having a length equal to one-quarter wavelength of the mid-range frequency of the frequency band. The first portion configured as an inner conductive cylindrical sleeve coaxially aligned with the whip. The second portion, an outer conductive cylindrical sleeve, coaxially aligned with inner sleeve. A coaxial conductor having an inner conductor electrically connected to the whip and an outer conductor connected to the second element. A coaxial choke axially aligned with the conductor, having a length of one-quarter wavelength of the mid-range frequency band, a first end of the choke connected to the outer conductor and a second end being spaced from the second element an equivalent distance as the choke length.

11 Claims, 3 Drawing Sheets

DUAL BAND SLEEVE DIPOLE ANTENNA

FIELD OF THE INVENTION

The present invention relates to the field of antennas, more specifically to a dual band dipole antenna adapted to receive and transmit high frequency signals, such as cellular telephone signals.

BACKGROUND OF THE INVENTION

With the growth of wireless communications, there has been an increased growth in the use of cellular technology to receive and transmit information using high frequency signals. Concurrent with the wireless growth has been the emergence of different very high frequency signal bands that these wireless devices may use.

Prior antennas have been designed to effectively receive and transmit signals along a specific frequency band, such as the cellular band or the AM/FM bands associated with most radios. Often times, an antenna must be designated to a specific frequency band due to the design and orientation of the various components. Most commonly, an antenna has a radiating element that provides the carrier wave for the transmitted host information. The relationship of the radiating element to other components restricts an antenna from varying its frequency range beyond a minimum threshold.

Cellular transmissions oscillate at a frequency between 824.04 and 893.7 MHz. An early analog cellular standard was called Advanced Mobile Phone System (AMPS). Newer developments in technology allows for cellular transmission to be in digital format, providing for signal compression and easier signal manipulation, thus increasing the available transmission bandwidth. Cellular telephones are duplex devices, providing for the transmission of dual signals, thus allowing a user to simultaneously transmit and receive data, with each signal being on a different frequency.

A transmission band commonly used with cellular technology is Global System for Mobile Communications (GSM), which provides encryption to the signal making the transmission more secure. This standard was initially established within Europe in the mid-1980s. GSM operates in the frequency band of 0.9 GHz within the United States and is used in conjunction with the Personal Communication System (PCS) based system.

A PCS phone operates in a frequency range between 1.85 and 1.99 GHz. A standard cellular transmission may be in AMPS, GSM, PCS, or PCN. These various standards are not completely interchangeable, therefore, a device may need to switch between standards to work properly.

Cellular antennas used for transmitting information along the cellular band are most commonly used with mobile devices, such as a telephone or a personal digital assistance (PDA). One common antenna assembly is taught by U.S. Pat. No. 5,440,317 issued to Jalloul et al., teaching a known assembly for a half wavelength sleeve dipole antenna having a coaxial line section followed by a quarter wavelength choke for reducing interference with the housing. U.S. Pat. No. 5,440,317 further teaches the interconnection of the various antenna elements, wherein several elements have a length of one-fourth of the wavelength of the corresponding frequency.

Although, U.S. Pat. No. 5,440,317 only teaches a single sleeve element, wherein the antenna is equipped to transmit and receive communications along a single frequency band. It is also known within the art to produce an antenna capable of transmitting and receiving in certain multiple bands. Specifically, U.S. Pat. No. 5,079,562 issued to Yarsunas et al. teaches a multi-band antenna adapted to receive and transmit signals in two bands, one in the cellular band and the other in the AM/FM band.

U.S. Pat. No. 5,440,317 teaches an AM/FM band antenna coaxially aligned with a cellular band antenna. The AM/FM antenna is formed of tubular rods, wherein the cellular antenna is formed of a centered coaxial dipole. U.S. Pat. No. 5,440,317 also teaches of a choke placed between the antennas to reduce or eliminate any interference between the AM/FM transmission/reception and the cellular band reception/transmission. This patent teaches the transmission and reception of only a single cellular band in conjunction with an AM/FM band. Furthermore the antenna is explicitly designed to not be used in multiple cellular bands, but is rather exclusively limited to a multi-band antenna consisting of an AM/FM band and a cellular band due to poor isolation between the antenna portions.

As such, there currently exists a need in the art for an antenna assembly capable of receiving and transmitting signals in multiple cellular bands without these signals being subject to various degradations.

SUMMARY OF THE INVENTION

The present invention provides an antenna assembly capable of transmitting in a plurality of cellular bands, such as AMPS/PCS or GSM/PCN. The antenna comprises a center-fed coaxial dipole having a first and second element for radiating and receiving electromagnetic energy in a plurality of frequency bands. The second element includes a first portion and a second portion, wherein the first and second portions, and the first element, have a length equivalent to approximately one-quarter wavelength of approximately the mid-range of each frequency band.

The first element is configured as a whip. The first portion is configured as an inner conductive cylindrical sleeve coaxially aligned with the first element. The second portion is configured as an outer conductive cylindrical sleeve coaxially aligned with the inner sleeve and the first element.

The antenna further comprises a coaxial conductor having inner and outer conductors and being axially aligned with the center-fed coaxial dipole and extending through the second element of the dipole. The inner conductor of the coaxial conductor is electrically connected to the whip and the outer conductor of the coaxial conductor is electrically connected to the second element.

The antenna also has a coaxial choke, formed of a cylindrical sleeve of electrically conductive material, disposed about and axially aligned with the coaxial conductor. The coaxial choke has a length equivalent to approximately one-quarter wavelength of the frequency at approximately the mid-range of one of the frequency bands. The choke has a first end, which is remote from the dipole, being connected to the outer conductor of the coaxial conductor, and a second end which is disposed nearest the dipole, being spaced from the second element by a distance equivalent to approximately one-quarter wavelength of the frequency at approximately the mid-range of one of the frequency bands.

The antenna further comprises a housing consisting of a dielectric material, circumferentially encasing the dipole, a coaxial choke, and a portion of the coaxial conductor. The antenna also has a top insert that is fitted on the top of the housing and contactingly engages the whip portion of the dipole. Moreover, the antenna has a bottom insert which is fitted on the bottom of the housing and allows the coaxial conductor to pass therethrough. The bottom insert may then be attached to a mounting assembly.

DETAILED DESCRIPTION OF THE DRAWINGS

Figure 1:
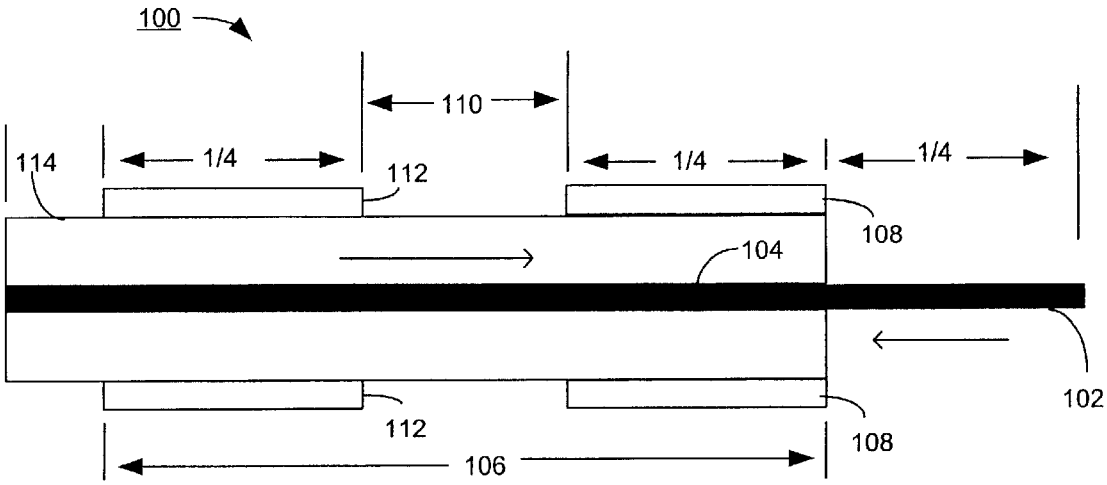
FIG. 1 PRIOR ART
FIG. 1 illustrates a prior art single band dipole antenna assembly.

FIG. 1 illustrates a prior art single band antenna assembly 100. The antenna comprises an antenna element 102 connected to an inner conductor 104 of a coaxial element 106, such as a standard coaxial cable. The first element 102 is nominally one-quarter wavelength long and has a sleeve 108 that is also one-quarter wavelength long. The first element 102 and the sleeve 108 form a half-wave sleeve dipole antenna. Below the sleeve 108 there is a coaxial line portion 110 having a sufficient length to minimize coupling between the sleeve 108 and a choke element 112, wherein the choke element 112 insures that the current at the outer surface of the outer conductor of the coaxial line is very low. As current flows towards the first element 102, the choke 112 causes the upward current flow to be equivalent to the downward current flow within the first element 102. The choke 112 also has a length of one-quarter wavelength to thereby properly terminate the connection of the coaxial element and allow additional coaxial feed line 114 of unspecified length to extend from the radiating portion.

Figure 2:
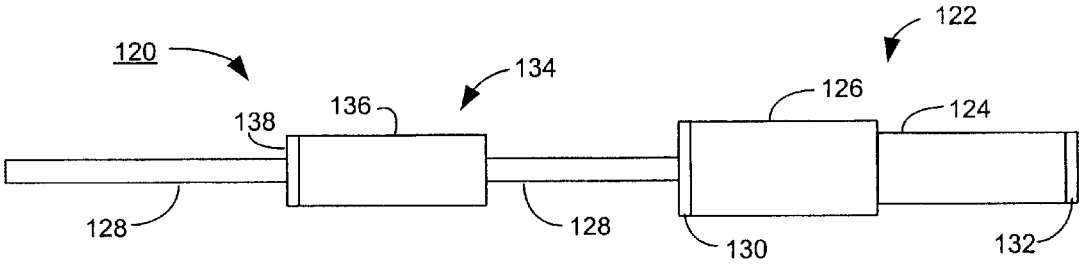
FIG. 2 illustrates a side view of a dual band sleeve dipole antenna in accordance with the present invention.

FIG. 2 illustrates several components of an antenna assembly in accordance with an embodiment of the present invention. The antenna is comprised of a center-fed coaxial dipole 120 wherein the dipole has a first element (not shown) and a second element 122 for transmitting and receiving high frequency signals. The first element is comprised of a whip with a phasing coil, providing a current distribution to make the gain of the antenna about 3 dB (see FIG. 6).

The second element 122 is comprised of a first portion, partially visible at 124 and a second portion 126. The length of the second element 122 is approximately one-quarter wavelength in the low frequency band and works as a counterpoise for radiating within the low frequency band. A sleeve holder 130 attaches each portion 124 and 126 to an inner tube assembly 128. In the preferred embodiment, the inner tube assembly has a diameter of approximately 3.94 mm. Furthermore, the second portion, otherwise known as an inner resonance sleeve 124, is attached to the housing using a second sleeve holder 132 at the feed point (see FIG. 4). This exposed part of 124 is the counterpoise element of the antenna at the high frequency band and it is about one-quarter wavelength of the center frequency of the high frequency band. Up to a choke on the whip, the first element, provides a current distribution to produce a gain of about 3 dB at the high frequency band.

Also illustrated in FIG. 2 is a choke assembly 134 axially disposed about the housing 128 and disposed from the second element 122 by a distance equivalent to approximately one-quarter of the wavelength of the high frequency band mid-range. The choke assembly 134 consists of a resonant sleeve assembly 136 secured to the inner tube 128 using a sleeve holder 138. Similar to the choke assembly of FIG. 1, the choke eliminates high frequency band currents going down the cable and allows the first portion 124 and the second portion 126 to properly radiate so as to transmit and receive high frequency signals.

Figure 3:
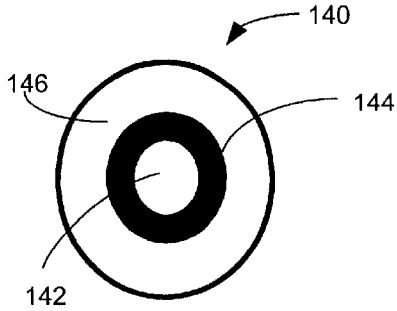
FIG. 3 PRIOR ART
FIG. 3 illustrates a cross-sectional view of a prior art coaxial conductor for use with antenna assembly of the present invention.

The electrical signal is transmitted to and from the assembly of FIG. 2 using a coaxial conductor, which in the preferred embodiment is a coaxial cable. FIG. 3 illustrates a cross-sectional view of the conductor 140. The conductor 140 consists of an inner conductor 142 and an outer conductor 146 separated by an inner dielectric material 144. The conductor 140 is electrically and mechanically attached to the inner tube 128 of FIG. 2.

Figure 4:
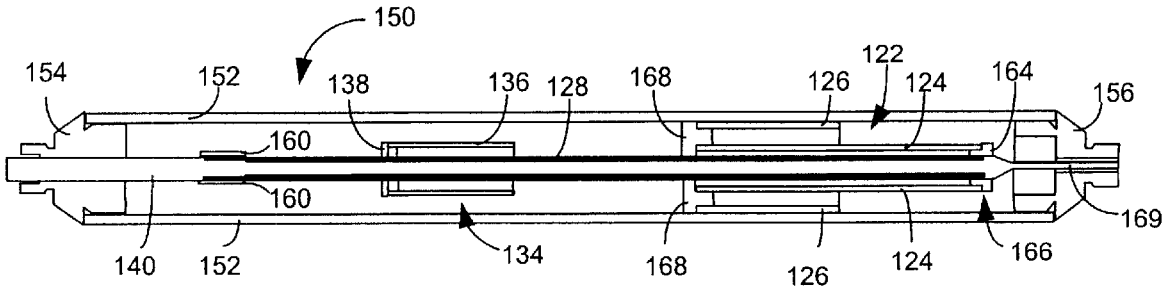
FIG. 4 illustrates a cross-sectional view of the dual band sleeve dipole antenna of the present invention enclosed within a tubular housing.

FIG. 4 illustrates a cross-sectional view of the dual band sleeve dipole antenna of the present invention, as disposed within the dual band housing assembly 150. The housing assembly 150 consists of a housing tube 152, a bottom insert 154, and a top insert 156. In the preferred embodiment, the top insert 156 and the bottom insert 154 are made of brass, but other materials as recognized by one of ordinary skill in the art, are incorporated herein. Disposed within the tube 152 is the coaxial conductor 140 that is fitted to the assembly of FIG. 2, also shown in cross-sectional view.

The housing 152 is formed of a dielectric tube into which the top insert 156 and bottom insert 154 are fitted. The inserts may be threaded, so as to provide a more secure fit with the housing assembly. The bottom insert 154 may then be affixed to a suitable mounting assembly. The top insert 156 is connected to a whip portion (not shown) of the antenna assembly, the whip portion also referred to as the first element as originally described with reference to FIG. 2. Each insert 154, 156 includes a bore extending therethrough. The bottom insert 154 allows the coaxial conductor to pass therethrough and the top insert provides the whip portion (not shown) to pass therethrough.

The coaxial conductor 140 passes through the bottom insert 154 and the outer conductor 146 of the cable is connected, via a ferrule 160, to the conductive inner tube 128 that extends along the longitudinal axis of the housing 152 for the substantial extent thereof. The choke assembly 134 consists of a first resonant sleeve 136 physically and electrically connected to the inner tube 128 by a sleeve holder 138. This choke assembly 134 has a desired length and diameter to function as a choke for the antenna system at the high band and is located a distance from the second resonant sleeve assembly 122, also referred to as the second element of FIG. 2, approximately one-quarter wavelength of the mid-range of the low frequency band.

The second resonant sleeve assembly 122 includes a pair of coaxial resonant sleeves and interconnecting sleeve holders. The inner sleeve 124, also referred to as the second portion of FIG. 2, is connected to the inner tube by a sleeve holder 164 at a feed point location 166 adjacent the top insert 154, furthest away from the choke assembly 134. The inner sleeve 124 has a desired length of approximately 81 mm and a diameter of approximately 8 mm to provide radiation in the low frequency band.

The length of the inner sleeve 124 is approximately two-thirds the length of the outer sleeve 126, also referred to as the first portion of FIG. 2, which is connected to the inner tube 128 by a holder 168 at the end of the inner sleeve, opposite the feed point 166 and nearest the first choke assembly 134. The outer sleeve 126 has a desired length of approximately 53.25 mm and a radius of approximately 12.7 mm to perform its intended function of radiating in the high frequency band. The diameter of the outer sleeve is larger than the diameter of the inner sleeve, whereby the outer sleeve 126 is neither in physical contact nor electrical contact with the inner tube 128 or the center conductor 142 of the coaxial conductor 140. Furthermore, the dimensions of sleeves provide for a length of 27.75 mm of the inner sleeve 124 to not be encased within the outer sleeve 126.

The center conductor 142 of the coaxial conductor 140 is surrounded by the inner dielectric material 144 and extends through the inner tube 162 to the feed point 166. The inner dielectric material 144 is discontinued past the feed point 166, however, the center conductor 142 extends through the bore 169 in the top insert 156. A whip portion (not shown) of the antenna assembly is connected to the top insert 156 and has a conductor located therein.

Figure 5:
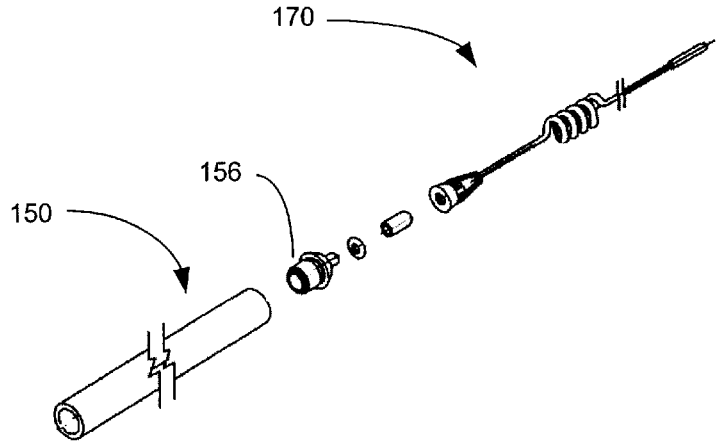
FIG. 5 illustrates an exploded view of an antenna assembly of the present invention.

In the preferred embodiment, the whip portion includes a phasing coil. FIG. 5 provides an exploded view of the dual band sleeve dipole antenna of FIG. 4 having a whip portion inserted thereon. The dual band housing assembly 150 is illustrated, having the top insert 156 therein. The exploded view illustrates the assembly of a whip portion 170 with the phasing coil to the top insert 156. Furthermore, upon the assembly of the whip portion 170 to the top insert, the inner conductor (not shown) is connected to the whip through the central bore of the top portion, as illustrated in FIG. 4. Thereupon, the first element 170 of the dual band sleeve dipole antenna is electrically and mechanically attached to the dual band housing assembly 150.

When the whip portion 170 having a phasing coil is properly coupled to the top insert 156, the whip is provided with two different lengths for affecting the variant frequency ranges. From the base of whip portion, the length of the first element is approximately one-quarter of the wavelength of the mid-range of the frequency range for the lower frequency band and approximately one-half of the wavelength of the mid-range of the frequency range for the higher frequency band. With the upper part of the whip included, the phasing coil provides a first portion having a length approximately equal to one-half the wavelength of the mid-range of the frequency range in the lower frequency band.

Figure 6:
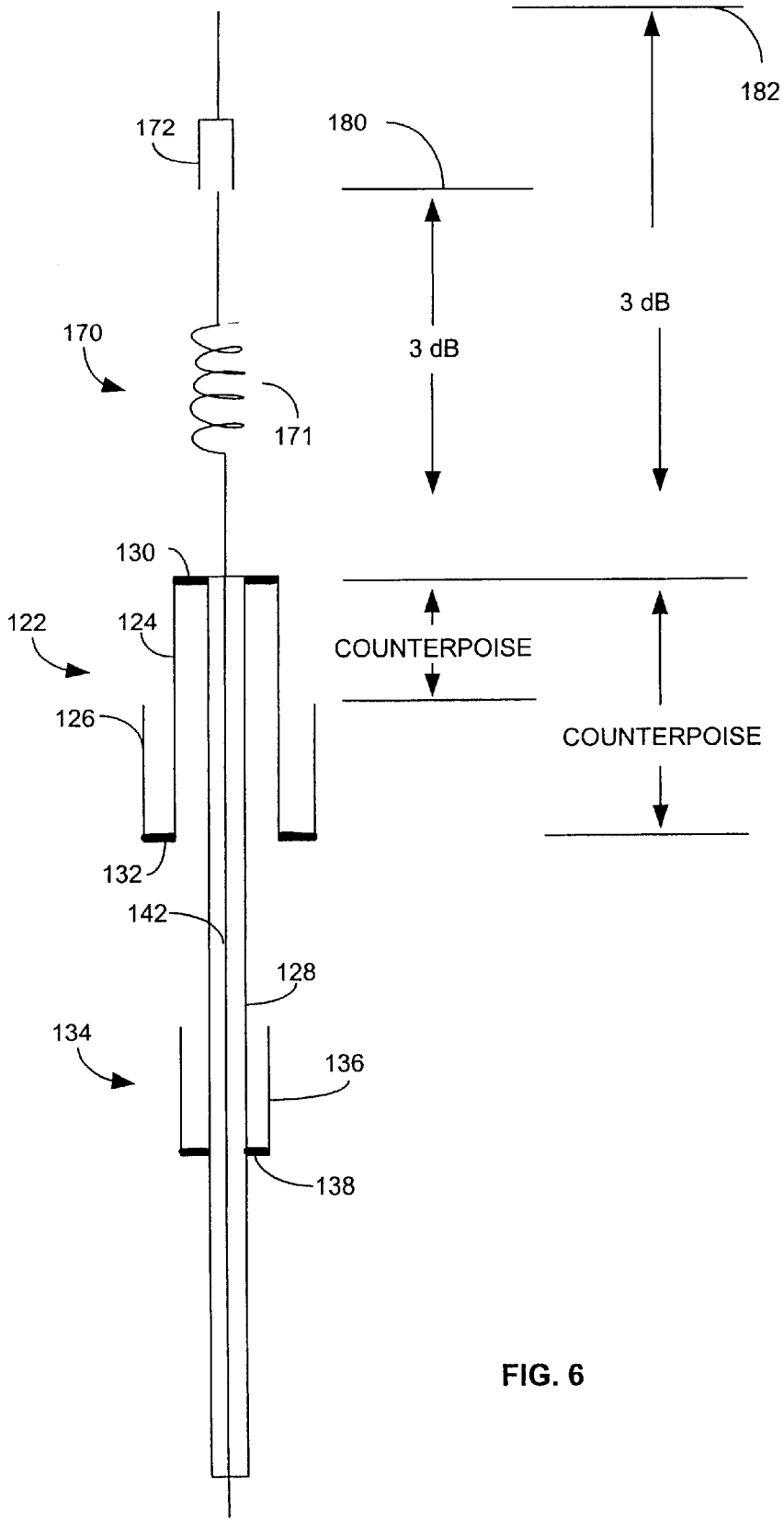
FIG. 6 illustrates a cross-sectional view of a dual band sleeve dipole antenna of the present invention having the whip portion attached thereon.

FIG. 6 (not to scale) illustrates a cross-sectional view the antenna assembly of the present invention having a whip portion 170 disposed thereon. FIG. 6 further illustrates the spatial relationship of the various antenna components and how the spacing provides the transmission in multiple frequency bands, at a gain of 3 dB, in relation to a counterpoise.

FIG. 6 is substantially similar to FIG. 2, with the addition of the whip portion 170. As previously discussed with reference to FIG. 5, the whip portion 170, otherwise referred to as the first element, is operably connected to the housing assembly 150 and electrically connected to the center conductor 142. Furthermore, the whip 170 has a phasing coil 171 disposed at a distance of approximately 55 mm from the base of the whip 170. In one embodiment of the present invention, the phasing coil 171 has a length of approximately 37 mm.

Furthermore, the whip portion 170 contains a choke assembly 172 disposed approximately 88 mm from the phasing coil 171. The choke assembly has a length of approximately 39.5 mm and a diameter of approximately 8 mm. With the inclusion of the top of the whip disposed above the choke 172, the whip 170 has a total length of approximately 297 mm.

When the antenna assembly transmits signals along the PCS/PCN band, the antenna elements resonant at a higher frequency band, designated at 180. The inner sleeve 124 not encased within the outer sleeve 126 acts as a counterpoise in conjunction with a 3 dB mast extending from the base of the phasing coil 171 to the choke assembly 172. Within this embodiment, the counterpoise has a length of approximately 27.75 mm and the mast has a length of approximately 180 mm.

When the antenna assembly transmits signals along the AMPS/GSM band, the antenna elements resonant at a lower frequency band, designated at 182. The second element 122 acts as the counterpoise and the whip portion provides the 3 dB mast. Within this embodiment, the counterpoise has a length of approximately 81 mm and the mast has a length of approximately 297 mm.

Further illustrated in FIG. 6 is the first resonant sleeve 136 attached to the inner tube 128 via the resonant sleeve assembly 138. This choke assembly 134, disposed posterior to the second element 122, eliminates RF currents generated by the antenna assembly radiating in the PCS/PCN band. As discussed above, with respect to FIG. 2, the choke assembly 134 is disposed a distance approximately equal to one-quarter of the wavelength of high frequency band mid-range, approximately 46 mm from the second element 122. Moreover, in the preferred embodiment, the resonant sleeve 136 has a length of approximately 39.5 mm and a diameter of approximately 8 mm.

The whip portion and the second element, the outer sleeve provide for radiation in the low frequency band. The whip portion extending to the choke 172 and the non-encased portion of the outer inner sleeve 124 provide for radiation in the high frequency band. As such, the dual band sleeve dipole antenna assembly of present invention provides for the transmission and reception of signals within the higher frequency band (PCS/PCN) and within the low frequency band (AMPS/GSM).

It should be understood that the implementation of other variations and modifications of the invention in its various aspects as may be readily apparent to those of ordinary skill in the art and that the invention is not limited by the specific embodiments described herein. It is therefore contemplated that the present disclosure is to cover any and all modifications, variations, or equivalents that fall within the spirit and scope of the basic underlying principles disclosed and claimed herein.

What is claimed is:

1. An antenna comprising:

a center-fed coaxial dipole having a first element and a second element for radiating and receiving electromagnetic energy in a plurality of frequency bands;

the second element comprising a first portion and a second portion, whereupon the first element, the first portion and second portion each have a length equal to approximately one-quarter wave length of approximately the mid-range of each frequency band, the first element configured as a whip;

the first portion configured as an inner conductive cylindrical sleeve coaxially aligned with the whip;

the second portion configured as an outer conductive cylindrical sleeve coaxially aligned with the inner sleeve and the whip;

a coaxial conductor having inner and outer conductors and being axially aligned with the dipole and extending through the second element of the dipole;

the inner conductor being electrically connected to the whip and the outer conductor being electrically connected to the second element;

a coaxial choke formed of a cylindrical sleeve of electrically conductive material disposed about and axially aligned with the coaxial conductor with the choke having a length equal to approximately one-quarter wavelength of the frequency at approximately the mid-range of one of the frequency bands;

a first end of the choke remote from the dipole being connected to the outer conductor of the coaxial conductor; and a second end of the choke nearest to the dipole being spaced from the second element by a distance equal to approximately one-quarter wavelength of the frequency at approximately the mid-range of one of the frequency bands.

2. The antenna as recited in claim 1, wherein the dipole radiates and receives wireless telephone signals.

3. The antenna as recited in claim 2, wherein the plurality of frequency bands include AMPS and PCS.

4. The antenna as recited in claim 2, wherein the plurality of frequency bands include GSM and PCN.

5. The antenna as recited in claim 1, wherein the whip further includes a phasing coil.

6. The antenna of claim 1 further comprising:

a housing composed of a dielectric tube wherein the dipole is encased therein;

a top insert proximally disposed on the housing in contacting engagement with the whip; and a bottom insert distally disposed on the housing having the coaxial conductor pass therethrough.

7. The antenna of claim 6 wherein the inner conductor is electrically connected to the first element within a bore of the top insert and the first element is mechanically secured to the housing through contacting engagement with the top insert.

8. The antenna of claim 6 wherein the bottom is mounted to a mounting assembly.

9. An antenna comprising:

a housing composed of a dielectric tube;

a center-fed coaxial dipole having a first element and a second element for radiating and receiving cellular transmissions in a plurality of frequency bands;

the second element comprising a first portion and a second portion, whereupon the first element, the first portion and second portion each have a length equal to approximately one-quarter wave length of approximately the mid-range of each frequency band, the first element configured as a whip;

the first portion configured as an inner conductive cylindrical sleeve coaxially aligned with the whip;

the second portion configured as an outer conductive cylindrical sleeve coaxially aligned with the inner sleeve and the whip;

a coaxial conductor having inner and outer conductors and being axially aligned with the dipole and extending through the second element of the dipole;

the inner conductor being electrically connected to the whip and the outer conductor being electrically connected to the second element;

a coaxial choke formed of a cylindrical sleeve of electrically conductive material disposed about and axially aligned with the coaxial conductor with the choke having a length equal to approximately one-quarter wavelength of the frequency at approximately the mid-range of one of the frequency bands;

a first end of the choke remote from the dipole being connected to the outer conductor of the coaxial conductor;

a second end of the choke nearest to the dipole being spaced from the second element by a distance equal to approximately one-quarter wavelength of the frequency at approximately the mid-range of one of the frequency bands.

a top insert proximally disposed on the housing in contacting engagement with the whip; and a bottom insert distally disposed on the housing having the coaxial conductor pass therethrough.

10. The antenna of claim 9, wherein the plurality of frequency bands include AMPS and PCS.

11. The antenna of claim 9 wherein the plurality of frequency bands include GSM and PCN.

* * * * *